US005593118A

United States Patent [19]

Kneile

[11] Patent Number: 5,593,118

[45] Date of Patent: Jan. 14, 1997

[54] FURNITURE FRAME

[75] Inventor: Karl Kneile, Holzmaden, Germany

[73] Assignee: Robert Krause GmbH & Co. KG Zweigniederlassung Weilheim/Teck, Weilheim/Teck, Germany

[21] Appl. No.: 443,056

[22] Filed: May 17, 1995

[30] Foreign Application Priority Data

May 18, 1994 [DE] Germany ..... 94 08 173 U

[51] Int. Cl.[6] ..... A47G 23/02

[52] U.S. Cl. ..... 248/150; 108/145; 248/166; 248/370

[58] Field of Search ..... 108/145; 248/150, 248/370, 166, 170, 188.6, 188.2, 462, 463, 460, 188.7

[56] References Cited

U.S. PATENT DOCUMENTS 3,688,705 9/1972 Barabas ..... 108/145 X 5,476,050 12/1995 Zimmer et al. ..... 108/145

*Primary Examiner*—Ramon O. Ramirez

*Attorney, Agent, or Firm*—Robert W. Becker & Associates

[57] ABSTRACT

A furniture frame, especially a table frame, that includes a support having upright support parts. Intermediate link members are pivotably connected to the support parts. A carrier member is provided that carries a panel and has carrier parts that are pivotally connected to the intermediate link members. The carrier member is movable between a lower position of use and an upper position of use in which the support parts, the intermediate link members, and the carrier parts extend upwardly and together with the panel enclose a free space. At least one connecting member is provided and has a center portion as well as end portions that are pivotably connected to the intermediate link members at pivot locations. The end portions extend upwardly from these pivot locations, and the center portion in the upper position of use, extends at least substantially in a region beyond the free space when viewed in the direction of the pivot axes of the furniture frame.

14 Claims, 3 Drawing Sheets

IV
1a
2a
3a
9a
10a
13a
14a
15a
22a
25a
28a
29a
30a
31a
32a
33
34
35
36
37
38
39
40
41
42
1
2

VII
VII
IX
52
32b
31b
37b
29b
33b
39b
53
47
45
14b
27b
15b
43
25b
50
44
46
51
49
30b
48
28b
13b
26b

FURNITURE FRAME

Background of the Invention

The present invention relates to a furniture frame, especially a table frame.

Pursuant to one known furniture frame (DE-PS 24 15 572), it is possible by pivoting the carrier parts to shift the plate or panel, which is, for example, a table top, into an upper and into a lower position of use. Connected to intermediate link members are the ends of two connector parts that reinforce the furniture frame and lead to a satisfactory synchronized movement during the adjustment process. In the upper position of use of the furniture frame, the superimposed support parts, intermediate link members, and carrier parts, together with the panel, enclose a free space when viewed in the direction of the pivot axis of the furniture frame. In the upper position of use, the connector parts are disposed approximately half way up the furniture frame. These connector parts or rods have a considerable adverse effect upon the leg room.

It is therefore an object of the present invention to improve the furniture frame of the aforementioned general type in such way that in the upper position of use, the leg room is not or at most only slightly adversely affected.

Brief Description of the Drawings

This object, and other objects and advantages of the present invention, will appear more clearly from the following specification in conjunction with the accompanying schematic drawings, in which.

Summary of the Invention

Figure 2:
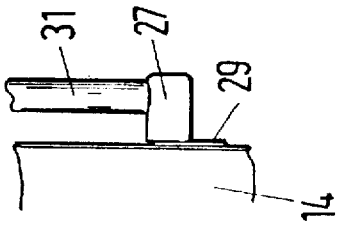
FIG. 2 is a view taken in the direction of the arrow II in FIG. 1.

The furniture frame of the present invention is characterized primarily by: support means having upright support parts; intermediate link members pivotably connected to the support parts; a carrier member that carries a panel and has carrier parts that are pivotably connected to the intermediate link members, the carrier member being movable between a lower position of use and an upper position of use in which the support parts, the intermediate length members, and the carrier parts extend upwardly and together with the panel enclose a free space; and at least one connecting member having a center portion and also having end portions that are pivotably connected to the intermediate link members at pivot locations, the end portions of the connecting member extending upwardly from the pivot locations, and the center portion of the connecting member, in the upper position of use, extending at least substantially in a region beyond the free space when viewed in the direction of the pivot axes of the furniture frame.

Pursuant to the inventive furniture frame, the center portion of the connecting member extends in the region beyond the free space, when viewed in the direction of the pivot axes of the furniture frame. As a consequence, the inventive furniture frame has an optimum leg room, i.e. freedom of the leg, in the upper position of use. Since the ends of the connection member extend upwardly from where they are connected to the intermediate link members, the leg room is not adversely affected.

Further specific features of the present invention will be described in detail subsequently.

Description of Preferred Embodiments

The inventive furniture frame is designed for use in mobile homes, cabins, and the like, and can be moved or adjusted out of the upper position of use illustrated in the drawings into a lower position of use in which it is very low to the ground.

Figure 1:
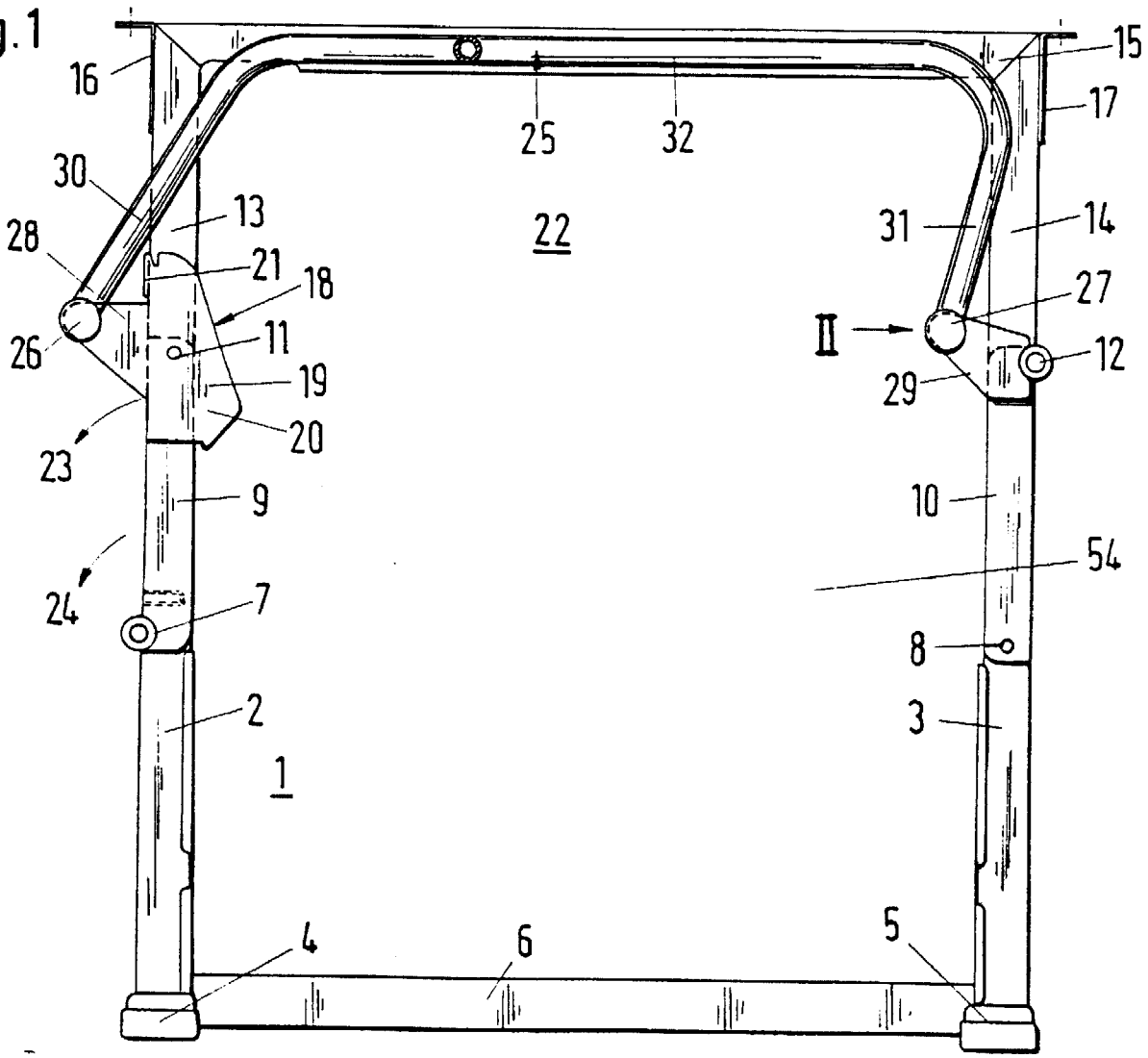
FIG. 1 is a side view of a first exemplary embodiment of the furniture frame.

Referring now to the drawings in detail, the furniture frame illustrated in FIG. 1 comprises a support means 1 having two oppositely disposed parts 2 and 3. Each of these support parts extends at right angles from a respective base 4, 5 by means of which the furniture frame rests upon the floor. The bases 4, 5 extend at right angles to the support parts 2, 3 and parallel to one another. The bottom ends of the support parts 2, 3 are interconnected by a cross member 6 that is advantageously disposed on edge and contributes to a great stability of the frame. The cross member 6 also interconnects the two bases 4, 5.

The bottom ends of intermediate link members 9 and 10 are connected to the upper ends of the support parts 2, 3 by shafts or spindles 7 and 8 that extend parallel to one another. When viewed from the side and in the upper position of use of the furniture frame as illustrated in FIG. 1, the intermediate link members 9, 10 form a continuation of the support parts 2, 3. The pivot axis 7 is disposed on that side of the intermediate link member 9 that is remote from the intermediate link member 10. The other pivot axis 8 is disposed approximately in the middle of the intermediate link member 10.

The bottom ends of parts 13, 14 of a carrier member 22 are connected to the upper ends of the intermediate link members 9, 10 via respective shafts or spindles 11, 12. The upper ends of the carrier parts 13, 14 are interconnected by an upper cross member 15. The outer sides of the support parts 13, 14 that face away from one another are each provided with an angular fitting 16, 17, the upper sides of which are disposed in a common plain with the upper side of the cross member 15 and serve for the mounting of a furniture panel, table top, or the like. The fittings 16, 17 extend at right angles to the carrier parts 13, 14 and to the cross member 15, and on both sides project beyond these components. This provides proper support for the furniture panel, table top, etc.

The pivot spindle 11 via which the intermediate link member 9 and the carrier part 13 are pivotably interconnected, is disposed approximately in the middle of the intermediate link member 9 and the carrier part 13. On the other hand, the pivot spindle 12 is provided on that side of the intermediate link member 10 that is remote from the intermediate link member 9.

In the upper position of use illustrated in FIG. 1, the furniture frame has its maximum height. The support parts 2, 3, the intermediate link member 9, 10, and the carrier part 13, 14 are respectively disposed vertically above and in alignment with one another, and together with the panel or table top enclose a free space 54 as viewed in the direction of the pivot spindles 7, 8, 11, 12. In order for the furniture frame to maintain this upper position of use, a locking means 18, which is not shown in greater detail, is provided and comprises a U-shaped retainer member 19, which is mounted near the upper end of the intermediate link member 9 and has two legs 20 that are correspondingly disposed on opposite outer sides of the intermediate link member 9. In the upper position of use illustrated in FIG. 1, these legs 20 are also disposed on opposite outer sides of the carrier part 13. The two legs 20 are interconnected by a cross piece 21 that extends on that outer side of the carrier part 13 that is remote from the carrier part 14.

One of the legs 20 of the retainer member 19 is provided with a non-illustrated arresting opening or arresting member, while the carrier part 13 is provided with a cooperating arresting part or arresting opening. When the furniture frame is moved into the upper position of use, the arresting member automatically engages the arresting opening. This prevents the carrier member 22, with its parts 13 and 14, from unintentionally pivoting out of this upper position of use. When the furniture frame is in this upper position of use, the cross piece 21 rests against the carrier part 13.

The support parts 2, 3, the intermediate link members 9, 10, and the carrier parts 13, 14 are advantageously formed by U-shaped members that are disposed in such a way that the legs of oppositely disposed members are directed towards one another. In order to facilitate movement of the furniture frame into the upper position of use, a non-illustrated gas spring, tension spring, compression spring, or the like is accommodated in the support part 3 and is connected to the intermediate link member 10.

In order to be able to shift the furniture frame into the lower position of use, the locking engagement between the carrier part 13 and the intermediate link member 9 is released in a known manner. The carrier member 22 is then pivoted in the direction of the arrow 23, whereby the carrier parts 13, 14 are pivoted relative to the intermediate link members 9, 10 about the spindles 11, 12. As the carrier member is lowered further, the intermediate link member 9, 10 are pivoted downwardly in the direction of the arrow 24 about the spindles 7, 8. In the lower position of use, the intermediate link members 9, 10 are then disposed next to the support parts 2, 3, while the carrier part 13, 14 are disposed next to the intermediate link members 9, 10. The furniture frame can again be locked into position in a known manner in this lower position of use. The panel or the like that is located on the carrier member 22 is then disposed approximately at the level of the upper ends of the support parts 2, 3.

The support parts 2, 3, the intermediate link members 9, 10, and the carrier parts 13, 14 advantageously have approximately the same length. In this way, in the lower position of use the furniture frame is not very high, whereas in the upper position of use it has a great height.

The two intermediate link members 9, 10 are interconnected by at least one connecting rod 25, the ends of which are pivotably connected to the intermediate link members via spindles 26 and 27 that extend parallel to the pivot spindles 7, 8, 11 and 12. When the furniture frame is viewed from above, the connecting rod 25 is disposed in a region beyond the intermediate link members 9, 10, the support parts 2, 3, and the carrier parts, 13, 14, so that the connecting rod does not obstruct the adjustment movement of the furniture frame. In every pivot position, the connecting rod 25 is disposed horizontally.

The pivot spindles 26, 27 are provided on side pieces 28 and 29 that are disposed on the retainer member 19 and the intermediate link member 10 respectively. As shown in FIG. 1, the side piece 28 projects beyond the retainer member 19 on that side thereof remote from the intermediate link member 10 so that the pivot spindle 26 is spaced from the intermediate link member 9. The side piece 29 projects beyond the intermediate link member 10 in a direction towards the intermediate length member 9. The pivot spindle 27 is provided on the free end of the side piece 29 and is therefore disposed within the furniture frame, i.e. within the free space 54, when viewed in the direction of the pivot spindles 7, 8, 11 and 12.

The two side pieces 28, 29 are disposed in a common plain directly next to the intermediate link members 9 and 10. As can be seen in FIG. 2, the pivot spindles 26, 27 project at right angles from the side pieces 28, 29 on that side that faces away from the intermediate link members 9, 10. The end portions 30, 31 of the connecting rod 25 are secured in the vicinity of the free ends of the spindles 26, 27, so that these end portions are adequately spaced from the side pieces 28, 29 and can therefore move in an unobstructed manner during shifting or adjustment of the furniture frame.

The two end portions 30, 31 of the connecting rod 25 are bent downwardly in a same direction from the center portion 32, with the end portion 30 forming an obtuse angle with the center portion while the end portion 31 forms an acute angle with the center portion. In the upper position of use of the furniture frame, the majority of the length of the connecting rod 25 is disposed at the level of the cross member 15 and is slightly spaced next to this cross member. The bent away end portions 30, 31 are disposed in such a way that they project only slightly into the region of the furniture frame enclosed by the support parts 2, 3 the intermediate link member 9, 10 and the carrier parts 13, 14, as viewed in the direction of the pivot spindle 7, 8, 11 and 12. In this way, in the upper position of use the furniture frame has an optimum leg space. There is therefore no danger that people using the furniture frame will accidentally bump their legs against the connecting rod 25.

Figures 3, 4, 5:
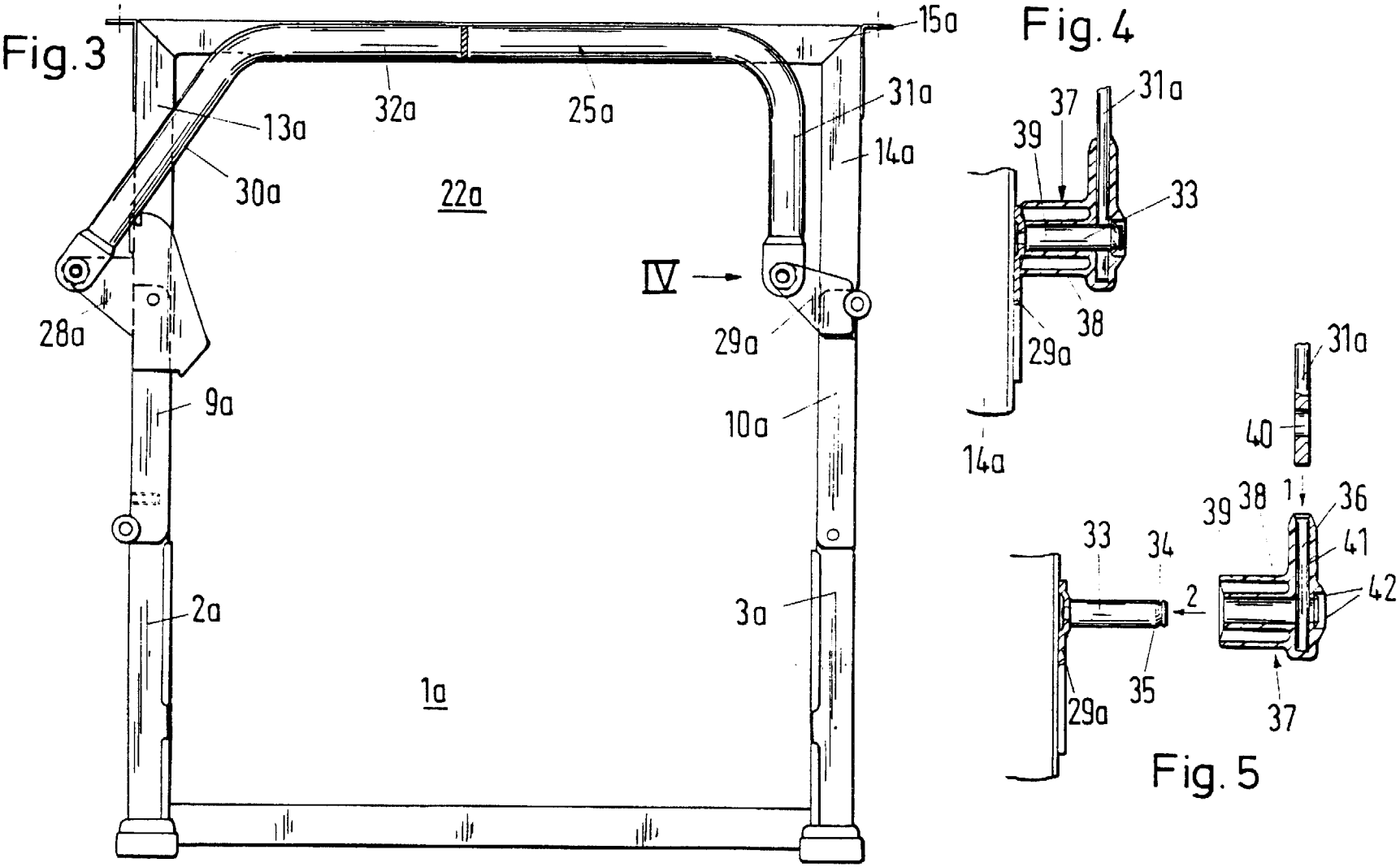
FIG. 3 is side view of a second exemplary embodiment of the inventive furniture frame.
FIG. 4 is a partially cross-sectioned view taken in the direction of the arrow IV in FIG. 3.
FIG. 5 is a partially cross-sectioned exploded view showing the connection of a connecting rod of the furniture frame of FIG. 3.

In principle, the furniture frame illustrated in FIGS. 3 to 5 has the same configuration as the embodiment illustrated in FIGS. 1 and 2. The embodiment of FIGS. 3 to 5 has the support means 1*a* with the parts 2*a*, 3*a* which are pivotably connected via the intermediate link members 9*a*, 10*a* to the parts 13*a*, 14*a* of the carrier member 22*a*. As with a previously described embodiment, the support parts 2*a*, 3*a*, the intermediate link members 9*a*, 10*a*, and the carrier parts 13*a*, 14*a* are essentially aligned one above the other in the upper position of use (FIG. 3). The connecting rod 25*a* has a square cross-sectional configuration and is disposed on edge. In this way the connecting rod 25*a* does not require much space and does not get in the way during use of the furniture frame. The end portion 30*a* of the connecting rod 25*a* is bent of in the same manner as was described in connection with the previous embodiment. The opposite end portion 31*a* of the connecting rod 25*a*, however, is bent off downwardly at right angles and in the upper position of use of the furniture frame, when viewed from the side, is disposed within the carrier member 22*a* at a slight distance from the carrier part 14*a*. The central portion 32*a* of the connecting rod 25*a* is disposed over its entire length at the level of the cross member 15*a* and slightly spaced next to it. As with the previous embodiment, the end portion 30*a* of the connecting rod extends at an angle such that only in the corner region between the upper cross-member 15*a* and the carrier part 13*a* does it extend into the furniture frame when viewed from the side, as can be seen in FIG. 3. In this way, this embodiment of the inventive furniture frame also ensures optimum leg room in the upper position of use.

The end portions 30*a*, 31*a* of the connecting rod 25*a* are connected to the respective side pieces 28*a*, 29*a* in the same manner. Therefore, only the connection to the side piece 29*a* will be described in detail subsequently in conjunction with FIGS. 4 and 5.

Projecting from that side of the side piece 29*a* that is remote from the carrier part 14*a* is a pin 33 that is provided near its free end with a circumferential groove 34 (FIG. 5). The base of the groove 34 tapers conically in a direction towards the free end of the pin 33, with this base merging into an annular radially disposed arresting surface 35.

The end portion 31*a* of the connecting rod 25*a* is inserted into a receiving means 36 of a coupling member 37. The coupling member comprises a connector part 38 that has a central passage 39 into which the pin 33 projects in the mounted state. The passage 39 is disposed at right angles to the receiving means 36 and intersects the same. The end portion 31*a* of the connecting rod 25*a* is positively held in the receiving means 36. To allow the pin 33 to pass through, the end portion 31*a* is provided with an opening 40 through which the pin projects. In this manner, the end portion 31*a* is reliably connected to the coupling member 37 without the need for additional componance.

Projecting at right angles from that end of the connector part 38 that is remote from the side piece 29*a* is a receiving part 41 in which the receiving means 36 is provided.

As shown in FIG. 5, projecting at an angle inwardly from the inner wall of the passage 39 and distributed over the circumference thereof are spring tongues 42 that in the installed state engage the groove 34 of the pin 33.

The coupling member 37 and the pin 33 ensure a very straightforward assembly. To begin with, the end portion 31*a* of the connecting rod 25*a* is inserted into the receiving means 36 to such an extend that the end of the end portion rests against the base of the receiving means 36. The opening 40 of the end portion 31*a* is then aligned with the passage 39 of the connector part 38. The coupling member 37 is then inserted upon the pin 33. In so doing, the spring tongues 32, which in the direction of insertion are angled forward and radially inwardly, are resiliently bent back until they can snap into the groove 34 of the pin 33. Since the spring tongues 42 are disposed on that side of the end portion 31*a* of the connecting rod 25*a* that is remote from the side piece 29*a*, the connecting rod 25*a* is kept from slipping out of the coupling member 37 by means of the pin 33. The coupling member can turn on the pin 33 during shifting of the furniture frame out of the lower position of use into the upper position of use, and vice versa, as required.

The coupling member 37 with the connector part 38 and the receiving part 41 is advantageously a one-piece part, especially of plastic.

In other respects, the furniture frame illustrated in FIGS. 3 to 5 is the same configuration as that of the embodiment shown in FIGS. 1 and 2.

Figures 6, 7, 8, 9, 10:
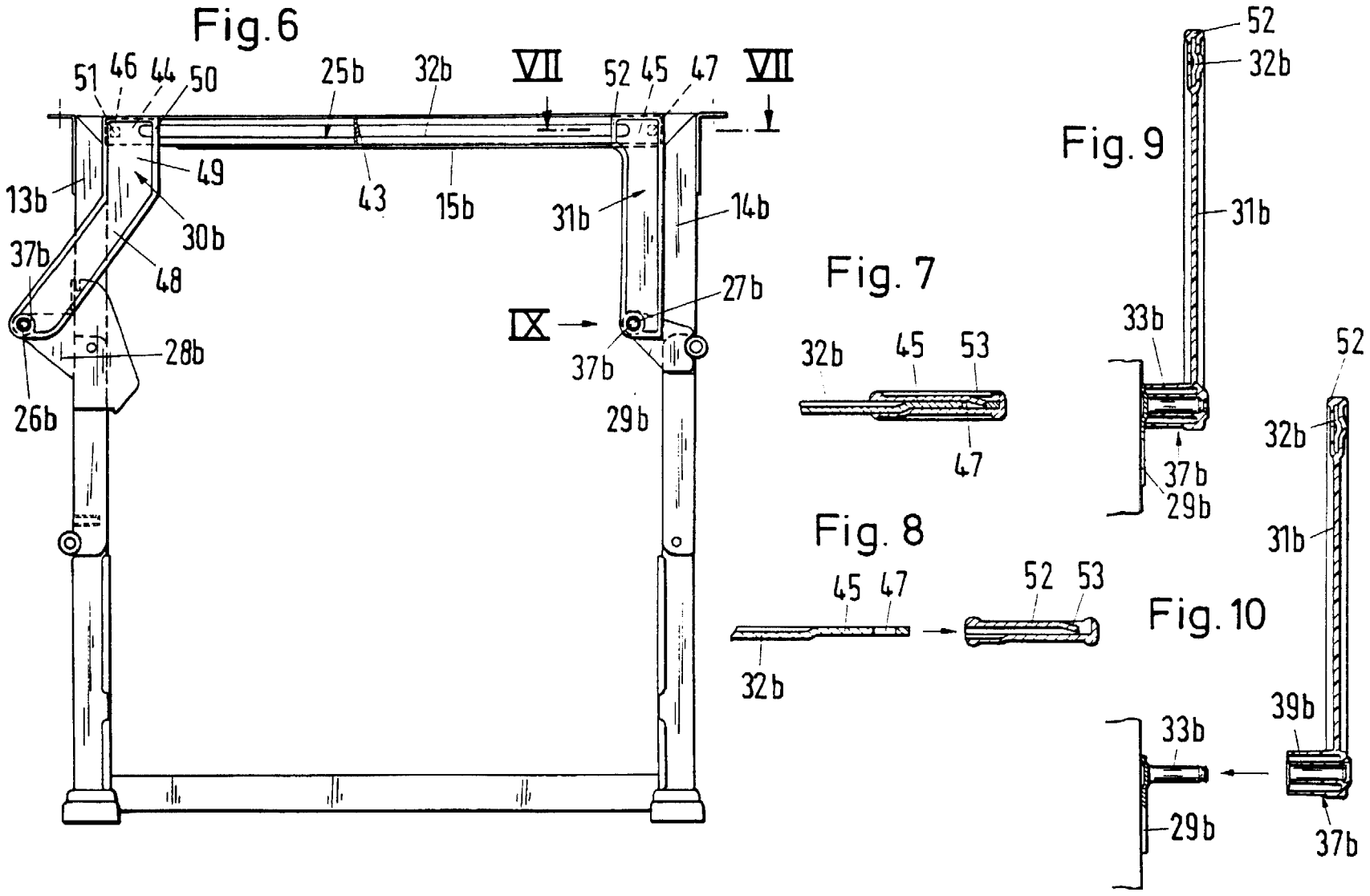
FIG. 6 is a side view of a third exemplary embodiment of the inventive furniture frame.
FIG. 7 is a cross-sectional view taken along the line VII—VII in FIG. 6.
FIG. 8 is a cross-sectional exploded view showing the connection of the ends of the center portion of the connecting rod of the furniture frame of FIG. 6.
FIG. 9 is a cross-sectional view taken in the direction of the arrow IX in FIG. 6 showing one end of the connecting rod of the furniture frame of FIG. 6.
FIG. 10 is a cross-sectional exploded view showing an end of the connecting rod and its connection to the furniture frame.

The furniture frame of the embodiment illustrated in FIGS. 6 to 10 also has a connecting rod 25*b*, which is embodied and disposed in such a way that in the upper position of use shown in FIG. 6, the furniture frame ensures optimum leg room. In contrast to the previously described embodiments, the connecting rod 25*b* is made of several pieces. The connecting rod 25*b* has a central portion 32*b*, the entire length of which extends linearly, with its ends being connected to the end portions 30*b* and 31*b* via a respective snap connection that will be described subsequently.

The central portion 32*b* is formed by a flat piece that is disposed edgewise and that, in order to increase its rigidity, is provided in the middle with a bead 43 that extends over nearly the entire length. The two ends of the central portion 32*b* are embodied as insert pieces 44 and 45 that are flat along their entire length (FIG. 8). Close to their free ends, the insert pieces 44, 45 are respectively provided with an arresting opening 46, 47.

The end portion 30*b* has an angular configuration, including, when viewed in the upper position of use of the furniture frame, an inclined part 48 that extends at an angle from the pivot shaft 26*b* and merges via an obtuse angle with a verticle part 49. In the upper position of use illustrated in FIG. 6, the part 49, when viewed from the side, is disposed right next to that side of the carrier part 13*b* that faces the carrier part 14*b*. At its free end, the part 49 is embodied in the form of a pocket 50 into which is inserted the insert piece 44 of the central portion 32*b*. The insert piece 44 is accommodated in an interlocking manner in this pocket 50. One wall of the pocket 50 has a tongue-like detent 51 that is bent out inwardly at an angle; when viewed in the direction of insertion of the insert piece 44, the detent 51 is directed forwardly and at an angle inwardly. Thus, when the insert piece 44 is inserted into the pocket 50, the detent 51 is bent resiliently back until it can engage into the arresting opening 46 of the insert piece 44.

The end portion 31*b* is linear over its entire length and in the upper position of use of the furniture frame extends vertically upwardly from the pivot shaft 27*b*. At its upper end, which is remote from the pivot shaft 27*b*, the end portion 31*b* is also provided with a pocket 52 into which is inserted the insert piece 45 of the central portion 32*b*. As shown in FIGS. 7 and 8, one wall of the pocket 52 is provided with a tongue-like detent 53 which, just like the detent 51, when viewed in the direction of insertion of the insert piece 45 is directed forward and at an angle inwardly. When the insert piece 45 of the central portion 32*b* is inserted into the pocket 52, the detent 53 is bent back resiliently until it can engage into the arresting opening 47 of the insert piece 45 (FIG. 7). The insert piece 45 is then satisfactorily secured from being pulled out.

The two end portions 30*b*, 31*b* are advantageously made of plastic and are advantageously integrilly formed with the coupling member 37*b*. As shown in FIG. 10, the coupling member 37*b* has a central passage 39*b* that accommodates the pin 33*b* of the side pieces 28*b*, 29*b*. Attachment of the coupling member 37*b* on the pin 33*b* is effected in the same manner as described with the previous embodiment of FIGS. 3 to 5. However, in contrast to this embodiment, the end 30*b*, 31*b* is integrally embodied with the coupling member 37*b*.

Since the central portion 32*b* is connected to the two end portions 30*b*, 31*b* in the snap-in manner described, various lengths of furniture frames can be very easily provided with the appropriate connecting rod 25*b*. It is merely necessary to use different length central portions 32*b* that are snap-in connected to the end portions 30*b*, 31*b*.

As can be seen in the side view of FIG. 6, in the upper position of use of the furniture frame the end portion 31*b* extends directly next to the carrier part 14*b* within the furniture frame. In this position of use, the central portion 32*b* extends at the level of the upper cross member 15*b* of the furniture frame. In this way, also with this embodiment of the furniture frame the leg room is not adversely impacted by the connecting rod 25*b*. In addition, a simple assembly is ensured via the described snap connection of the end portions 30*b*, 31*b* with the side pieces 28*b*, 29*b* of the furniture frame. In other respects, this embodiment has the same configuration as does the embodiment of FIGS. 1 and 2.

The present invention is, of course, in no way restricted to the specific disclosure of the specification and drawings, but also encompasses any modifications within the scope of the appended claims.

What I claim is:

1. A furniture frame comprising:

support means having upright support parts;

intermediate link members pivotably connected to said support parts;

a carrier member that carries a panel and has carrier parts that are pivotably connected to said intermediate link members, said carrier member being moveable between a lower position of use and an upper position of use in which said support parts, said intermediate link members, and said carrier parts extend upwardly and together with said panel enclose a free space; and at least one connecting member having a center portion and also having end portions that are pivotably connected to said intermediate link members at pivot locations, said end portions of said connecting member extending upwardly from said pivot locations, and said center portion of said connecting member, in said upper position of use, extending at least substantially in a region beyond said free space when viewed in a direction of pivot axes of said furniture frame.

2. A furniture frame according to claim 1, when said center portion of said connecting member extends directly below said panel.

3. A furniture frame according to claim 2, wherein said carrier member includes a cross member that connects upper ends of said carrier parts remote from said intermediate link members, and wherein said center portion of said connecting member is disposed at the level of said cross member.

4. A furniture frame according to claim 1, wherein said pivot locations include pivot shafts on said intermediate link members, and wherein each of said end portions of said connecting member is connected to one of said pivot shafts by means of a respective coupling member.

5. A furniture frame according to claim 4, wherein ends of said end portions remote from said center portion are embodied as insert parts for insertion and securement in receiving means of said coupling member.

6. A furniture frame according to claim 5, wherein said end portions of said connecting member are secured in place by said pivot shafts of said intermediate link members.

7. A furniture frame according to claim 6, wherein said coupling member is provided with an opening for receiving said pivot shaft, and wherein said end portions of said connecting member are each provided with an opening that is aligned with said opening of said coupling member and receives said pivot shaft.

8. A furniture frame according to claim 4, wherein said pivot shaft is provided with annular groove, and said coupling member is provided with spring tongues that engage in said annular groove.

9. A furniture frame according to claim 8, wherein said spring tongues are disposed on a side of said end portions of said connecting member that is remote from the respective intermediate link member.

10. A furniture frame according to claim 4, wherein said coupling member is integral with said end portions of said connecting member.

11. A furniture frame according to claim 4, wherein said end portions and said center portion of said connecting member are snap-connected to one another.

12. A furniture frame according to claim 11, wherein said end portions are provided with pockets for receiving ends of said center portion.

13. A furniture frame according to claim 12, which includes arresting means for holding said ends of said center portion in said pockets of said end portions of said connecting member.

14. A furniture frame according to claim 13, wherein said arresting means comprise at least one detent disposed in each of said pockets for engaging in an arresting opening of said ends of said center portion.

* * * * *